United States Patent [19]

Nariai et al.

[11] Patent Number: 4,571,950

[45] Date of Patent: Feb. 25, 1986

[54] METHOD FOR CONTROLLING AIR-CONDITIONER

[75] Inventors: Shigeru Nariai, Kusatsu; Yasunori Himeno, Ohtsu; Naoki Shimokawa, Shiga, all of Japan

[73] Assignee: Matsushita Electric Industrial Co., Ltd., Kadoma, Japan

[21] Appl. No.: 641,288

[22] Filed: Aug. 16, 1984

[30] Foreign Application Priority Data

Aug. 20, 1983 [JP] Japan ..... 58-152125

[51] Int. Cl.[4] ..... F25D 17/06; F24F 7/00

[52] U.S. Cl. ..... 62/89; 62/180; 98/39.1; 236/49

[58] Field of Search ..... 236/49; 62/180, 89; 98/39, 94 AC; 165/43

[56] References Cited

U.S. PATENT DOCUMENTS

| | | | |
|---|---|---|---|
| 3,398,889 | 8/1968 | Bohannan | 62/180 X |
| 3,899,022 | 8/1975 | Persson | 165/39 X |
| 3,948,154 | 4/1976 | Asakai et al. | 236/49 |

*Primary Examiner*—William E. Wayner

*Attorney, Agent, or Firm*—Wenderoth, Lind & Ponack

[57] ABSTRACT

A method for controlling an air-conditioner wherein the blowing capacity of an indoor fan for supplying air, cooled by an indoor heat-exchanger forming a part of the refrigeration system, into a house room to cool the latter is irregularily switched over between strong and weak states so that a pleasing sensation of a breeze (i.e., a cold wind of an irregularily varying velocity) can be enjoyed by a dweller in the room.

6 Claims, 9 Drawing Figures

METHOD FOR CONTROLLING AIR-CONDITIONER

BACKGROUND OF THE INVENTION

The present invention relates to a method for controlling an air-conditioner.

With the conventional air-conditioner operating as a cooler, it is known to cool the space, for example, a house room, by supplying a cooled air into the space through a built-in fan which is continuously driven at a predetermined speed. With this method, it is disadvantageous in that, since the cooled air being constantly supplied into the space, tends to impinge continuously upon a dweller in the space, the prolonged cooling of the space makes the dweller accustomed to the cooled atmosphere to such an extent as to cause him or her to be insensible to it and, therefore, the cooling effect afforded by the air-conditioner will no longer be appreciated. In addition, when the setting of a temperature is subsequently increased while the space is sufficiently cooled, the cooling effect, even though sufficient, tends to be regarded as short of the requirement. Accordingly, this conventional method tends to result in the waste of an electric power consumed by the air-conditioner and is, therefore, not energy-saving.

SUMMARY OF THE INVENTION

The present invention has for its essential object to provide an improved method wherein the blowing capacity of an indoor fan for supplying air, cooled by an indoor heat-exchanger forming a part of the refrigeration system, into a house room to cool the latter is irregularily switched over between strong and weak states so that a pleasing sensation of a breeze (i.e., a cold wind of an irregularily varying velocity) can be enjoyed by a dweller in the room.

A second object of the present invention is to provide an improved method wherein an indoor fan for supplying air, cooled by an indoor heat-exchanger is driven at a predetermined speed immediately after the start of the cooling operation, but when and after the temperature inside the room has attained a preset temperature subsequent to the start of the cooling operation, the blowing capacity of the indoor fan is irregularily switched over between strong and weak states so that the room can be cooled to a desired temperature in a short period of time subsequent to the start of the cooling operation, and when and after the temperature inside the room has been reduced to the desired temperature, the cooling of the room by the utilization of a breeze can be performed.

A third object of the present invention is to provide an improved method wherein, when the temperature of air inside the room is lowered to a preset OFF temperature as a result of the cooling operation, the supply of an electric power to both a compressor and an outdoor fan of the refrigeration system is interrupted by the detection thereof, but when the temperature of air inside the room increases to a present ON temperature, the supply of the electric power to both of the compressor and the outdoor fan is initiated and, at the same time, the blowing capacity of an indoor fan for supplying air, cooled by an indoor heat-exchanger, into the house room to cool the latter is irregularily switched over between strong and weak states during the period starting from the time at which the temperature of air inside the house room has attained the preset ON temperature and ending at the time at which the temperature of air inside the house room has subsequently attained the present OFF position, so that a sensation of a breeze can be given to the dweller in the house room.

A fourth object of the present invention is to provide an improved method wherein an indoor fan for supplying air, cooled by an indoor heat-exchanger, into a house room for cooling the latter is driven at a predetermined high speed subsequent to the start of the cooling operation and until the temperature of air inside the house room attains a preset OFF temperature; the refrigerating cycle is brought to a halt subsequent to the attainment of the temperature of air inside the house room to the present OFF temperature but before it increases to a preset ON temperature; and during a period in which the temperature of air inside the house room then equal to the present ON temperature increases to the present OFF temperature, the indoor fan is controlled so as to irregularily switch the blowing capacity thereof over between strong and weak states in a low speed range so that not only can the dweller in the house room enjoy a pleasant sensation of a breeze, but also since when the blowing capacity of the indoor fan changes the indoor fan is necessarily in the low spped range and since the extent of change of noises resulting from the change of the blowing capacity is small, the possibility of the dweller feeling discomfort with noises can be minimized.

A fifth object of the present invention is to provide a method wherein, while the cooling operation is interrupted when the temperature of air inside a house room has attained a preset OFF temperature, the cooling operation is again initiated, when the temperature of air inside the house room has attained a preset ON temperature, and at this time the blowing capacity of an indoor fan for supplying air, cooled by an indoor heat-exchanger, is irregularily switched over between strong and weak states to permit both of the preset OFF and ON temperatures to be suitably increased, whereby the time during which the air-conditioner is operated can be reduced to minimize the consumption of an electric power and, at the same time, the dweller can enjoy a sensation of a pleasant breeze.

A sixth object of the present invention is to provide an improved method wherein the irregular switching of the blowing capacity of the indoor fan between the strong and weak states is accomplished by alternately interrupting and effecting the supply of an electric power to a drive motor of the indoor fan on a random basis, wherefore not only can the dweller in the house room enjoy a pleasant sensation of a breeze as if he or she were to be at a highland, but the consumption of the electric power by the air-conditioner can also be minimized

BRIEF DESCRIPTION OF THE DRAWINGS

These and other objects as well as features of the present invention will readily be understood from the following description taken in conjunction with a preferred embodiment thereof with reference to the accompanying drawings, in which.

DETAILED DESCRIPTION OF THE PREFERRED EMBODIMENT

Figure 1:
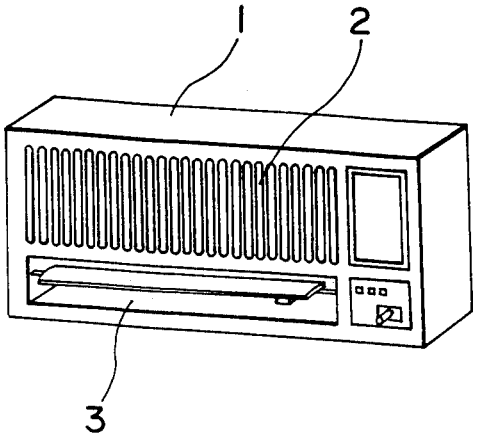
FIG. 1 is a perspective view of an air-conditioner in which the present invention is embodied.

Before the description of the present invention proceeds, it is to be noted that like parts are designated by like reference numerals throughut the accompanying drawings.

Figure 2:
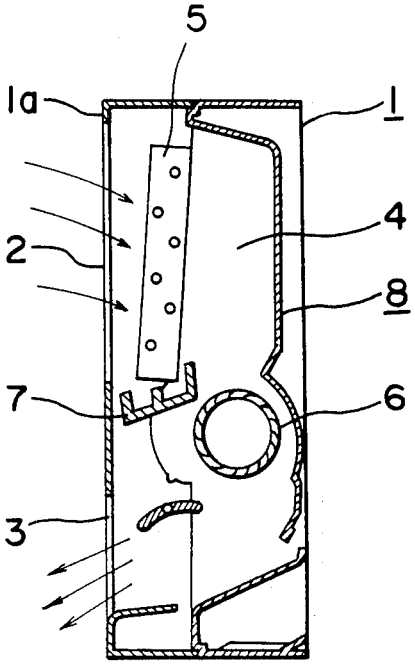
FIG. 2 is a side sectional view of the air-conditioner shown in FIG. 1.

The structure of an air-conditioner will be first described schematically with particular reference to FIGS. 1 and 2.

Shown generally by 1 is an indoor unit of a split type air-conditioner. This indoor unit 1 is comprised of a generally rectangular box-like cabinet 8 having a front grille panel 1*a*. The grille panel 1*a* has a air-intake opening 2 and an air discharge opening 3 both defined therein, the discharge opening 3 being positioned below the intake opening 2. The cabinet 8 has an air passage 4 defined therein and communicating between the intake and discharge openings 2 and 3 and also has a heat-exchanger 5, forming a part of any known refrigerating cycle, and an indoor fan (a cross-flow fan) 6 both disposed in the passage 4 within the cabinet 1. Positioned immediately below the heat-exchanger 5 is a drain tray which concurrently serves as a stabilizer for the indoor fan 6.

The indoor unit of the structure described with reference to and shown in FIGS. 1 and 2 is similar to that currently well known to those skilled in the art. Although not shown in FIGS. 1 and 2, the indoor unit of the structure shown in FIGS. 1 and 2 is provided with an air filter and a drive motor for indoor fan as is well known to those skilled in the art.

Figure 3:
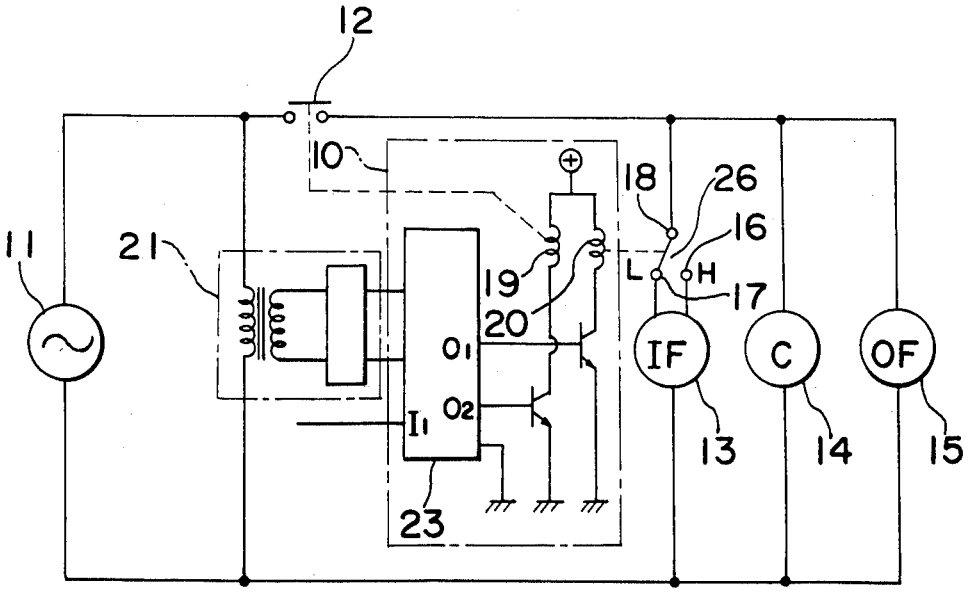
FIG. 3 is a schematic diagram showing an electric circuitry employed in the air-conditioner.

The electric circuitry employed in the air-conditioner will now be described with reference to FIG. 3.

The circuitry includes a power control switch 12 disposed in a circuit between a source 11 of electric power and any one of an indoor drive motor 3 for the indoor fan 6, a compressor 14 and an outdoor fan motor 15 for an outdoor fan which are conncected in parallel with each other. The indoor fan motor 13 has high and low speed terminals 16 and 17 to which a switching terminal 18 is selectively engageable for driving the indoor fan motor 13 at high and low speeds, respectively. Reference numeral 21 represents a transformer rectifier of any known construction operable to convert an alternating current, fed from the power source 11, into a direct current which is utilized by, and used to power, a fan control unit 10. In other words, the transformer rectifier 21 provides a source of electric power for the fan control unit 10. This control unit 10 includes parallel-cnnected relay coils 19 and 20 for actuating the power switch 12 and the switching terminal 18, respectively.

Figure 4:
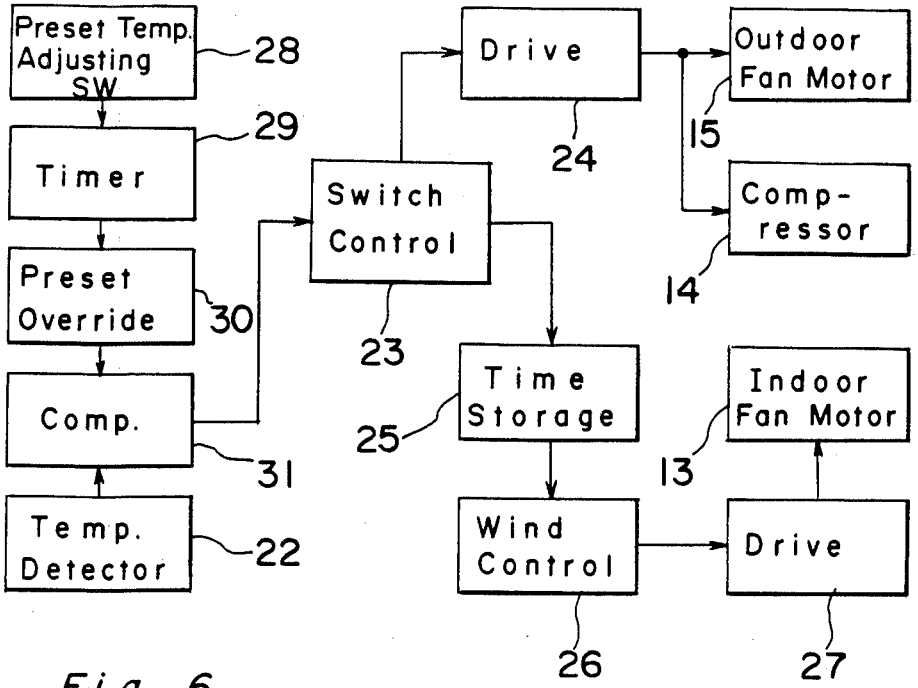
FIG. 4 is a block circuit diagram of a fan control device of the air-conditioner.

The details of the fan control unit 10 will now be described with particular reference to FIG. 4.

The control unit 10 is operable to control the outdoor fan motor 15 and the compressor 14 by supplying an output from a temperature detector 22 to a switch control 23 through a comparison circuit 31, which switch control 23 then feeds its output to a drive circuit 24 by the on and off operation of switch 12.

With respect to the indoor unit, the output from the switch control 23 is fed to a time storage device 25 which generates a train of pulses having an irregularity in both pulse width and pulse intervals to a wind control 26 which in turn acts to effect the switching of the indoor fan 6 over between high and low speeds by the on and off control of the indoor fan motor 13 through a drive circuit 27.

When a preset temperature adjusting switch 28 is activated, a timer 29 counts the time elapsed from the moment at which the switch 28 has been activated, and, at the same time, preset override device 30 produces a first set temperature, which is in relation to the preset temperature. Then, after the passage of a predetermined time, such as one hour, the timer 29 generates an output to a preset override device 30 to change the first set temperature to second set temperature. The preset override device 30 generates an output signal indicative of the set temperature, which signal is in turn fed to the comparison circuiit 31 at which it is compared with the output from the temperature detector 22, and the switch control 23 then generate the output.

In the construction described above, in the case where the cooling operation is initiated, and if the result of comparison, performed by the comparison circuit 31, of the output, which has been fed to the circuit 31 from the adjusting switch 28 through the timer 29 and then through the override device 30, with the output fed from the temperature detector 22 indicates that the temperature of air inside the house room is higher then the set temperature B (FIG. 5), the switch control 23 is electrically energized to cause the switching terminal 18 to engage the high speed terminal 16, whereby the indoor fan motor 13 is driven at a high speed and, at the same time, both of the outdoor fan motor 15 and the compressor 14 are driven. When the temperature of air inside the house room attains a set OFF temperature A shown in the graph of FIG. 5, the fan motors 13 and 15 and the compressor 15 are brought to a halt.

The irregular blow control of cooled air achieved by the fan control unit will be hereinafter described in details.

Figure 5:
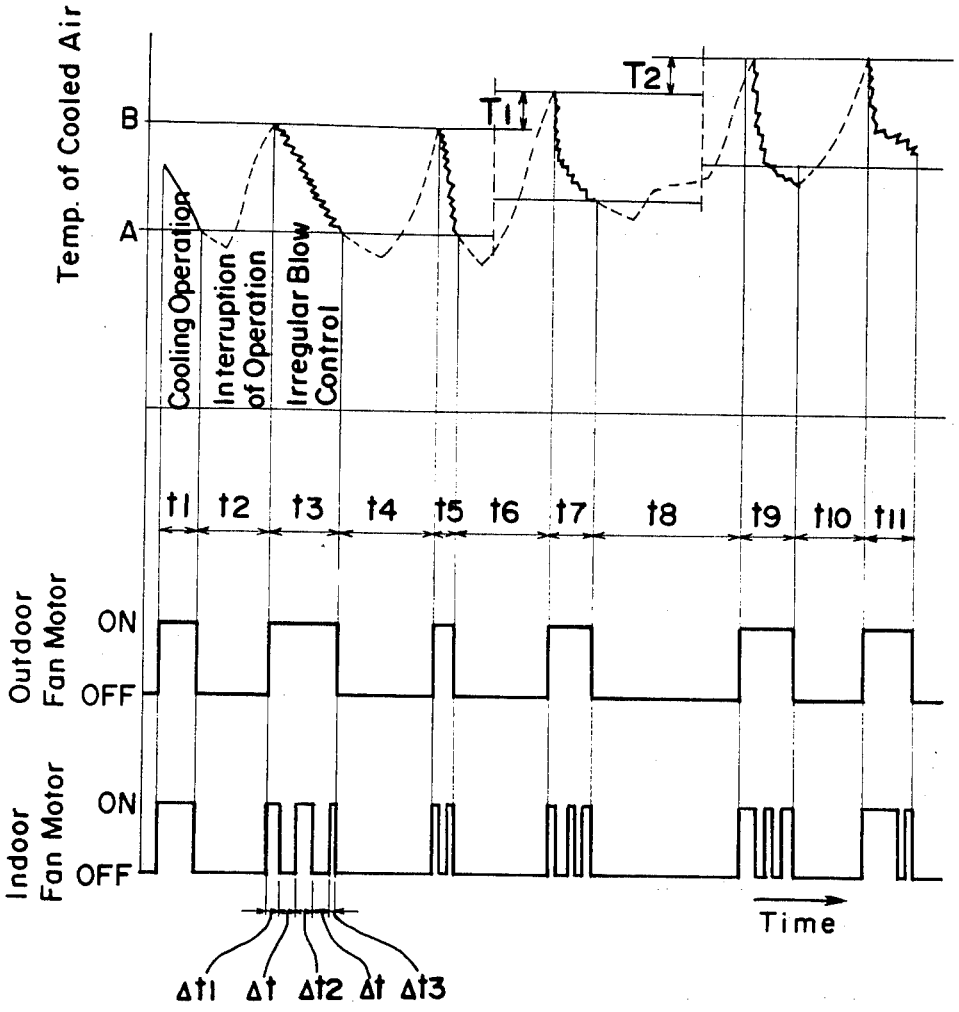
FIG. 5 is a chart used to explain the operation of the air-conditioner.
Figure 7:
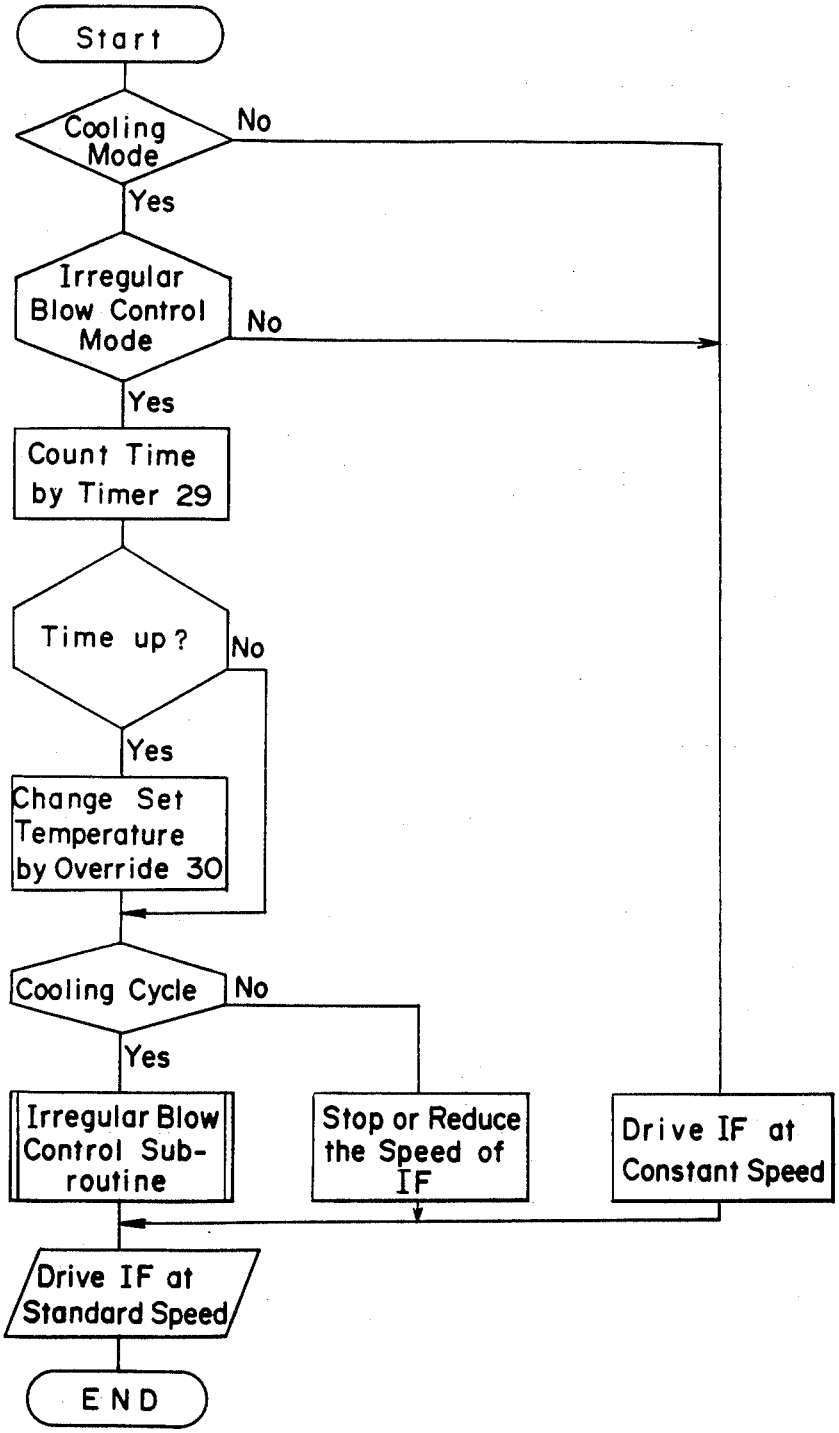
FIG. 7 is a flow chart showing the sequence of the air-conditioner.
Figure 8:
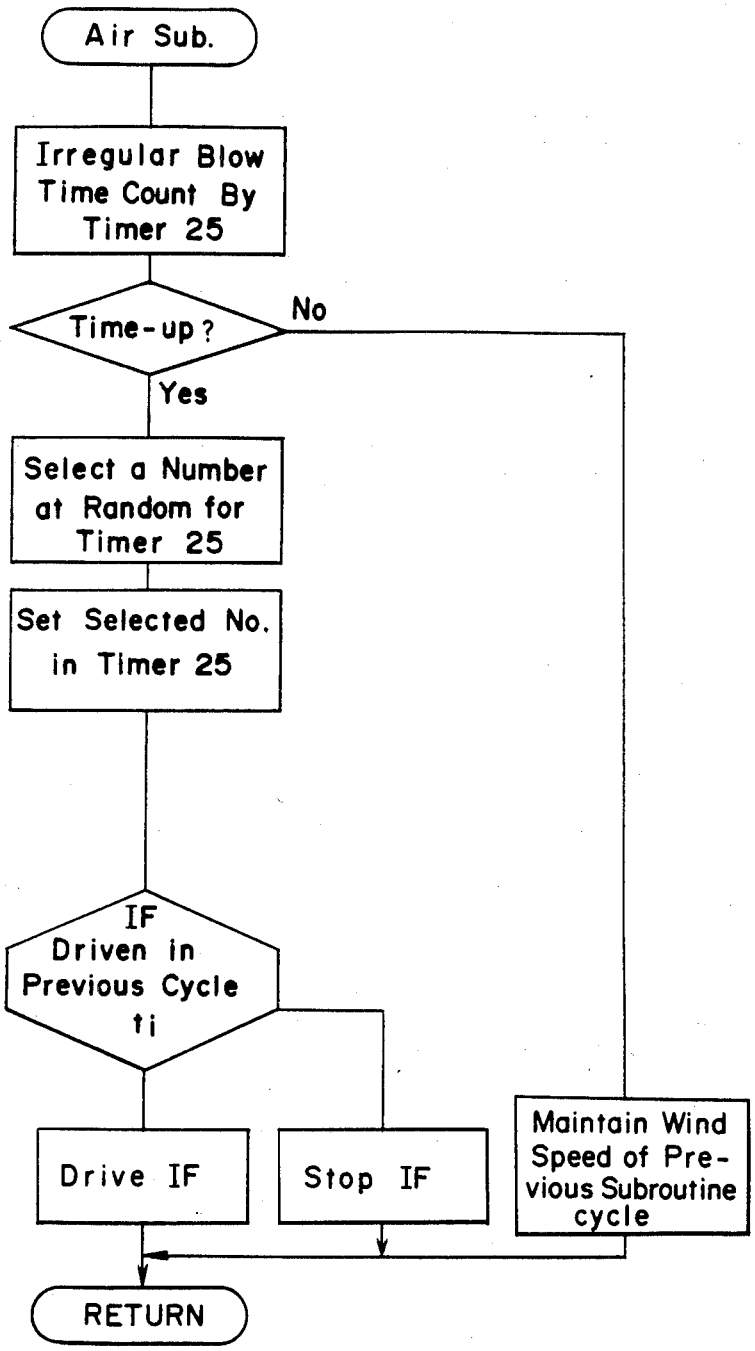
FIG. 8 is a flow chart showing a subroutine for the irregular blow control by the on and off control of an indoor fan motor.
Figure 9:
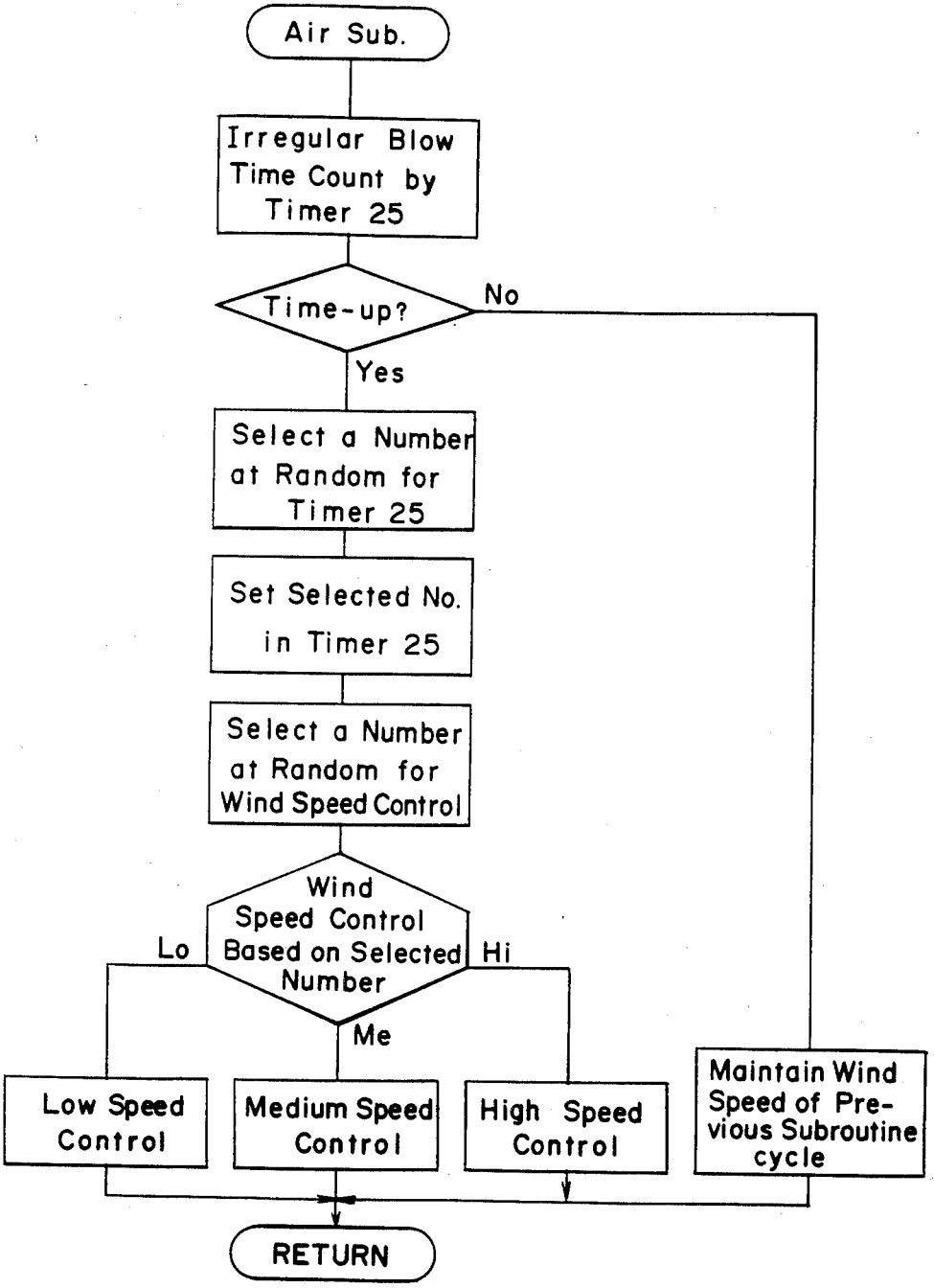
FIG. 9 is a flow chart showing a subroutine for the irregular blow control by randomly selecting the time for different wind speeds.

After the interruption of the operation and when the temperature detector 22 detects the increase of the temperature of air inside the house room to a value equal to or higher than the ON temperature B, the switch control 23 is energized to cause the drive circuit 24 to operate both the outdoor fan motor 15 and the compressor 14. At the same time, the indoor fan motor 13 is driven by the time storage device 25 so as to intermittently operate at irregular intervals while the wind control 26 cause the switching terminal 18 to disengage from the high speed terminal 16 and engage the low speed terminal 17 for permitting the indoor fan motor 13 tc be driven through the drive circuit 27. It is to be noted that each of the time spans shown by t1, t2, . . . t10, and t11 in FIG. 5 is only for the purpose of reference and is, therefore, not fixed. It is also to be noted that, although each of the OFF times $\Delta t$ during which the indoor fan motor 13 is inoperative is fixed, each of the ON times Δt1, Δt2 and Δt3 is determined by the time storage device 25 and is, therefore, not fixed.

The above described irregular control of the blow of the cooled air continues until the temperature of air inside the house room attains the set OFF temperature A at which time the operation is interrupted. In this way, the irregular control of the blow of the cooled air and the interruption of the operation are alternated and, after the subsequent passage of a first predetermined time, such as one hour, both of the set OFF and ON temperatures A and B are increased by T1° C. which are, after the further passage of a second predetermined time, such as thirty minutes, further increased by T2° C. Such predetermined times are counted by timer 29 and the increase of set temperatures is effected by preset override device 30.

More specifically, and referring particularly to FIG. 5, during each of the time spans t3, t5, t7, t9 and t11 at which time the irregular control of the blow of the cooled air is carried out, the switching terminal 18 is engaged to the low speed terminal 17 through which the supply of the electric power to the motor 13 is alternately switched on and off at irregular intervals. Each of the ON times Δt1, Δt2 and Δt3 during each of the time spans t3, t5, t7, t9 and t11 is determined by the time storage device 25 to a random value within the range of, for example, 5 to 30 seconds. Each of the OFF times Δt within the respective time span is fixed, for eample, to 3 seconds. Although during the irregular control of the blow of the cooled air the supply of the electric power to the motor 13 is alternately switched on and off, the OFF time during which the supply of the electric power to the motor 13 is switched off is of a relatively short duration, for example, 3 seconds and, therefore, the indoor fan 6 continues to rotate under the influence of an inertia force even during each of the OFF times Δt. Accordingly, the indoor fan 6 can exhibit a relatively high blowing capacity during each of the ON times Δt1, Δt2 and Δt3, but a relatively low blowing capacity during each of the OFF times Δt.

Figure 6:
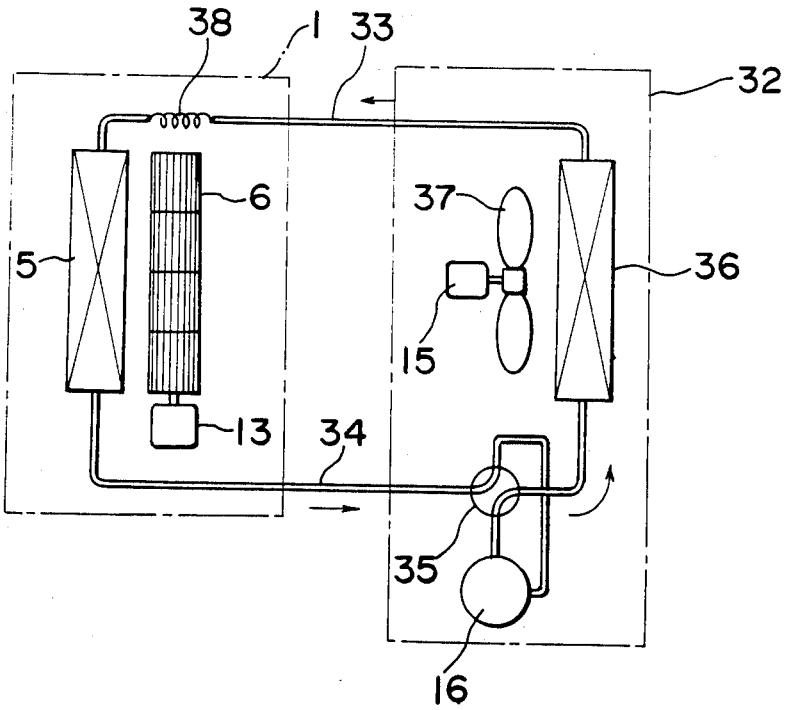
FIG. 6 is a diagram showing a refrigerating cycle of the air-conditioner.

Referring to FIG. 6, the refrigerating cycle will now be described. The indoor unit 1 is fluid-coupled with an outdoor unit 32 through two pipings 33 and 34. The outdoor unit 32 accommodates therein, in addition to the compressor 14, the outdoor fan 37 and the outdoor fan motor 15 for the outdoor fan 37, a four-way switching valve 35 for reversing the direction of flow of a coolant depending on the mode of operation of the air-conditioner, i.e., either the cooling mode or the heat pump mode, and an outdoor heat-exchanger 36. During the cooling mode of operation, the high temperature, high pressure coolant compressed by the compressor is supplied through the valve 35 to the outdoor heat-exchanger 36 at which it is condensed by the heat exchange with an air supplied by the outdoor fan 37. The coolant so condensed into a liquid state is, after having passed through an orifice device 38 at which the pressure thereof is reduced, supplied into the indoor heat-exchanger 5. The coolant flowing through the indoor heat-exchanger 5 is evaporated by absorption of heat from an air supplied from the indoor fan 6, forming a low pressure gaseous body which is in turn sucked through the valve 35 into the compressor 35. However, when the air-conditioner is set to operate under the heat pump mode, accompanied by the switching of the valve 35, the direction of flow of the coolant is reversed with respect to that during the cooling operation.

Although the present invention has fully been described in connection with the preferred embodiment thereof with reference to the accompanying drawings, it is to be noted that various changes and modifications are apparent to those skilled in the art. Such changes and modifications are to be understood as included within the scope the present invention as defined by the appended claims unless they depart therefrom.

What is claimed is:

1. A method for controlling an air-conditioner wherein an indoor fan for supplying air, cooled by an indoor heat-exchanger is driven at a predetermined speed immediately after the start of the cooling operation, but when and after the temperature inside the room has attained a preset temperature subsequent to the start of the cooling operation, the blowing capacity of the indoor fan is irregularily switched over between strong and weak states.

2. A method for controlling an air-conditioner, wherein when the temperature of air inside the room is lowered to a preset OFF temperature as a result of the cooling operation, the supply of an electric power to both a compressor and an outdoor fan of the refrigeration system is interrupted by the detection thereof, but when the temperature of air inside the room increases to a preset ON temperature, the supply of the electric power to both of the compressor and the outdoor fan is initiated and, at the same time, the blowing capacity of an indoor fan for supplying air, cooled by an indoor heat-exchanger, into the house room to cool the latter is irregularily switched over between strong and weak states during the period starting from thee time at which the temperature of air inside the house room has attained the present ON temperature and ending at the time at which the temperature of air inside the house room has subsequently attained the preset OFF position.

3. A method for controlling an air-conditioner wherein an indoor fan for supplying air, cooled by an indoor heat-exchanger, into a house room for cooling the latter is driven at a predetermined high speed subsequent to the start of the cooling operation and until the temperature of air inside the house room attains a preset OFF temperature; the refrigerating cycle is brought to a halt subsequent to the attainment of the temperature of air inside the house room to the present OFF temperature but before it increases to a preset ON temperature; and during a period in which the temperature of air inside the house room then equal to the preset On temperature increases to the preset OFF temperature, the indoor fan is controlled so as to irregularily switch the blowing capacity thereof over between strong and weak states in a low speed range.

4. A method for controlling an air-conditioner, wherein, while the cooling operation is interrupted when the temperature of air inside a house room has attained a preset OFF temperature, the cooling operatin is again initiated, when the temperature of air inside the house room has attained a preset ON temperature, and at this time the blowing capacity of an indoor fan for supplying air, cooled by an indoor heat-exchanger, is irregularily switched over between strong and weak states to permit both of the preset OFF and ON temperatures to be suitably increased as the operating time passes.

5. A method for controlling an air-conditioner, which comprises the steps of:

driving an indoor fan for suppying an air, cooled by an indoor heat-exchanger, into a house room to cool the latter, at a predetermined high speed immediately after the start of a cooling operation;

interrupting the operation of each of a compressor forming a refrigerating cycle, an outdoor fan for supplying an air to an outdoor heat-exchanger and the indoor fan when and after the temperature of air inside the house room has attained a preset OFF temperature;

effecting the operation of both of the compressor and the outdoor fan and driving a motor for the indoor fan at a low spped region when and after the temperature of air inside the house room has subsequently increased to a preset ON temperature; and increasing both of the OFF and ON temperature to suitable values;

wherein said effecting step is carried out by alternately effecting and interrupting the supply of an electric power to said motor at irregular intervals, the duration during which the electric power supply is effected is chosen at random while the duration which the electric power supply is interrupted is fixed.

6. A method for controlling an air-conditioner wherein the blowing capacity of an indoor fan for supplying air, cooled by an indoor heat-exchanger forming a part of the refrigeration system, into a house room to cool the latter is irregularly randomly switched over between strong and weak states, wherein the irregular switching over between the strong and weak states is carried out by alternately effectiving and interrupting the supply of an electric power to an indoor fan motor for the indoor fan and wherein the duration during which the electric supply is interrupted is fixed, but the duration during which the electric power supply is effected is randomly chosen.

* * * * *